US011661155B2

(12) United States Patent
Khaladj

(10) Patent No.: US 11,661,155 B2
(45) Date of Patent: May 30, 2023

(54) MULTIPLE POSITION FIN SUPPORT

(71) Applicant: Faramarz Khaladj, Laguna Niguel, CA (US)

(72) Inventor: Faramarz Khaladj, Laguna Niguel, CA (US)

( * ) Notice: Subject to any disclaimer, the term of this patent is extended or adjusted under 35 U.S.C. 154(b) by 0 days.

(21) Appl. No.: 16/987,085

(22) Filed: Aug. 6, 2020

(65) Prior Publication Data

US 2022/0041253 A1 Feb. 10, 2022

(51) Int. Cl.
*B63B 32/64* (2020.01)
*B63B 32/66* (2020.01)

(52) U.S. Cl.
CPC ..... *B63B 32/64* (2020.02); *B63B 32/66* (2020.02)

(58) Field of Classification Search
CPC ..... B63B 32/60; B63B 32/62; B63B 32/64
See application file for complete search history.

(56) References Cited

U.S. PATENT DOCUMENTS

| | | | | |
|---|---|---|---|---|
| 4,811,674 | A * | 3/1989 | Stewart | B63B 32/64 441/79 |
| 8,408,958 | B2 * | 4/2013 | Benham | B63B 32/64 441/79 |
| 9,139,265 | B2 * | 9/2015 | Peberdy | B63B 39/06 |
| 10,843,774 | B2 * | 11/2020 | Muller | B63B 32/64 |
| 2004/0248482 | A1 * | 12/2004 | Larkin | B63B 32/66 441/79 |

* cited by examiner

*Primary Examiner* — Andrew Polay
(74) *Attorney, Agent, or Firm* — Roy A. Ekstrand

(57) ABSTRACT

An improved support for a fin extending downwardly from the undersurface of a water sport board provides detented rotational positioning of the fin at a selected one of a plurality of angular positions including a vertical position for use, a right side position and a left side position both of which protect the fin from damage during periods of nonuse, transport and storage and which avoid the need for removal and reattachment of the fin between periods of use and periods of nonuse, transport and storage.

8 Claims, 9 Drawing Sheets

11
15
20
23
24
26
30
50
51
52
60
61

MULTIPLE POSITION FIN SUPPORT

FIELD OF THE INVENTION

This invention relates generally to watersport boards and particularly to surfboards and standup paddle boards. The invention relates more particularly to the apparatus utilized in securing one, or more, downwardly extending fins on the undersurfaces of such boards.

BACKGROUND OF THE INVENTION

Standup paddle boards, or simply "paddle boards", typically resemble surfboards but are substantially larger in both length and width. Paddle boards and surfboards often share a similar construction in which a foam core, shaped in accordance with the intended shape of the board, is wrapped and covered with an epoxy base fiberglass outer layer. Other materials are sometimes used in such fabrications, such as carbon fiber, to provide the outer layers. In addition to the rigid foam core type construction of paddle boards which resemble large surfboards, paddle boards are also fabricated in as inflatable structures. The use of inflatable construction may render the board somewhat less stable than the foam core construction. However, because inflatable boards are able to be "folded or compacted", they enjoy substantial advantages for convenience of storage and transport.

Over the years, paddle boards have dramatically increased in popularity and, as a result, practitioners in the art have fabricated paddle boards in a variety of shapes and sizes. However, within the variety of shapes and sizes of paddle boards available, most enjoy similar basic features. Thus, most paddle boards provide an elongated generally planar shape defining a somewhat pointed front end and a narrowed but usually more blunt rear end. The top surface of the typical paddle board is contoured for ease of standing while the bottom surface is usually configured to define a curved or hydrofoil contour.

In the anticipated use of such paddle boards, the user stands upon the board's upper surface and employs a lengthy paddle which is dipped and stroked on each side of the board to propel the user forward. To aid in controlling the travel path and help urge the board toward a straight line travel path, as the user paddles on alternating sides, paddle boards include a plurality of fins located at the rear of the board extending downwardly from the undersurface of the board. While the number, sizes and arrangement of such fins may vary, most utilize a combination of a larger center fin together with two smaller fins, one on each side of the center fan. This arrangement appears to have been generally accepted within the art as producing a minimum of lateral slipping and a tendency toward straight line travel together with acceptable speed and turning capabilities.

One of the more vexing problems to which such paddle boards and their smaller cousins, surfboards, have been subjected is the frequency with which the fins tend to become damaged when these boards are stored or handled in transport or periods of nonuse. In particular, the large center fin has proven to be problematic as a result of the frequent damage encountered.

The problems associated with fin damage persist in most sport board constructions including paddle boards and surfboards. Typically, in both board species the manner of attaching the fins to the undersurface of the board employs a fin box, or fin receptacle, that is embedded within the foam core body in general alignment with the undersurface thereof. In most constructions, the fin box and the fin utilize cooperating attachment mechanisms to secure the fin within the fin box in a removable attachment. The objective of providing a removable attachment is directed toward enabling the user to remove the fin during periods of nonuse, storage or transport. In addition, the removable fin attachment facilitates the replacement of a damaged fin. While such removable fin attachment apparatus are well intended, they often prove less than optimum in practical use. In many instances, users find removal and attachment of a fin between uses to be difficult and inconvenient. In addition, the user must carefully store the removed fin, or fins, during nonuse and take care to avoid loss or damage.

Faced with these difficulties, practitioners in the art have endeavored to address the problems associated with fin damage, particularly as it relates to the larger fins used in paddle boards, but in surfboards as well, by creating a variety of fin box and cooperating fin attachment designs. Unfortunately, while these attempts have provided some improvement and in some instances enjoyed limited commercial success, there remains nonetheless a continuing and unresolved need for improved fin support apparatus that effectively protects the fin during periods of nonuse, transport and storage.

SUMMARY OF THE INVENTION

Accordingly, it is a general object of the present invention to provide an improved support for a fin extending downwardly from the undersurface of a water sport board. It is a more particular object of the present invention to provide an improved support for a fin extending downwardly from the undersurface of a water sport board which protects the fin from damage during periods of nonuse, transport and storage. It is a further object of the present invention to provide an improved support for a fin extending downwardly from the undersurface of a water sport board which avoids the need for removal and reattachment of the fin between periods of use and periods of nonuse, transport and storage.

In accordance with the present invention, there is provided a multiple position fin support for supporting a fin upon the undersurface of a board, the multiple position fin support comprising: a base having a forward abutment, a rearward abutment and a gap therebetween; a tie-down extending downwardly from the fin base for engaging a board fin box; a fin box, supported between the abutments in the gap, movable in rotation and movable between a latched position and an unlatched position; a fin removably secured to the fin box; a latch operative in the latched position for detenting rotational movement of the fin box at selected rotational positions; and a spring urging the fin box toward the latched position, the fin box being movable to a selected one of the selected rotational positions by overcoming the spring to move the fin box from the latched position and rotating the fin box to the selected one of the selected positions.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
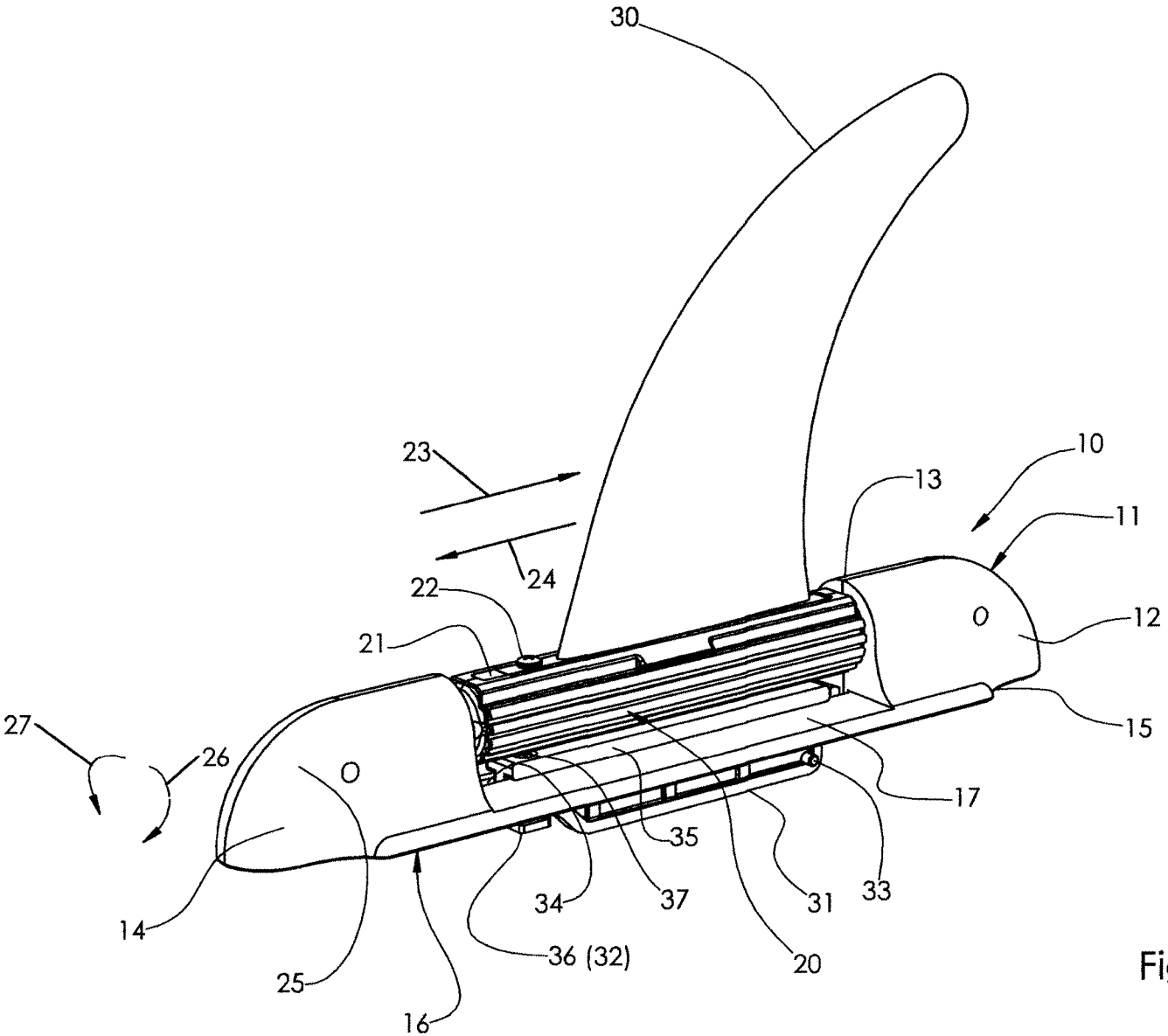
FIG. 1 sets forth a perspective view of a multiple position fin support constructed in accordance with the present invention supporting an illustrative fin in a vertical position.

FIG. 1 sets forth a perspective view of a multiple position fin support constructed in accordance with the present invention and generally reference by numeral 10. Fin support 10 includes a fin base 11 formed of a pair of mirror image base halves 12 and 13 which are joined by conventional fasteners. Fin base 11 includes a forward abutment 14 and a rearward abutment 15 separated by a gap 17. Fin base 11 further includes slot 34 extending the length of gap 17. Within gap 17, a fin box 20 is supported in the manner described below in greater detail. As is also described below in greater detail, fin box 20 is movable within gap 17 between abutments 14 and 15 in the directions indicated by arrows 23 and 24 and is rotatable about an axis of rotation 25. Fin box 20 defines a fin slot 21 which receives the lower portion of a conventional fin 30 which, in turn, is secured to fin box 20 by a conventional fastener 22. Fin support 10 further defines a bottom surface 16 which is generally planar and configured to be received upon the undersurface of a cooperating board (shown in FIG. 5).

Fin support 10 further includes a tie-down 31 which defines a flange 36 and a pin 33. Tie-down 31 is captivated within slot 34 and extends downwardly through slot 34 beyond bottom surface 16. Tie-down 31 facilitates attachment of fin base 11 to a cooperating board in an attachment set forth below in greater detail relating to FIG. 5. Suffice it to note here that, in the anticipated use of fin support 10, a cooperating board such as a paddleboard, or a surfboard, provides an otherwise conventional board fin box on the undersurface thereof which is normally utilized in receiving a conventional fin. In further accordance with the present invention tie-down 31 utilizes this board fin box to secure fin base 11 to the undersurface of the cooperating paddleboard or surfboard in the manner set forth below in FIG. 6.

Figure 2:
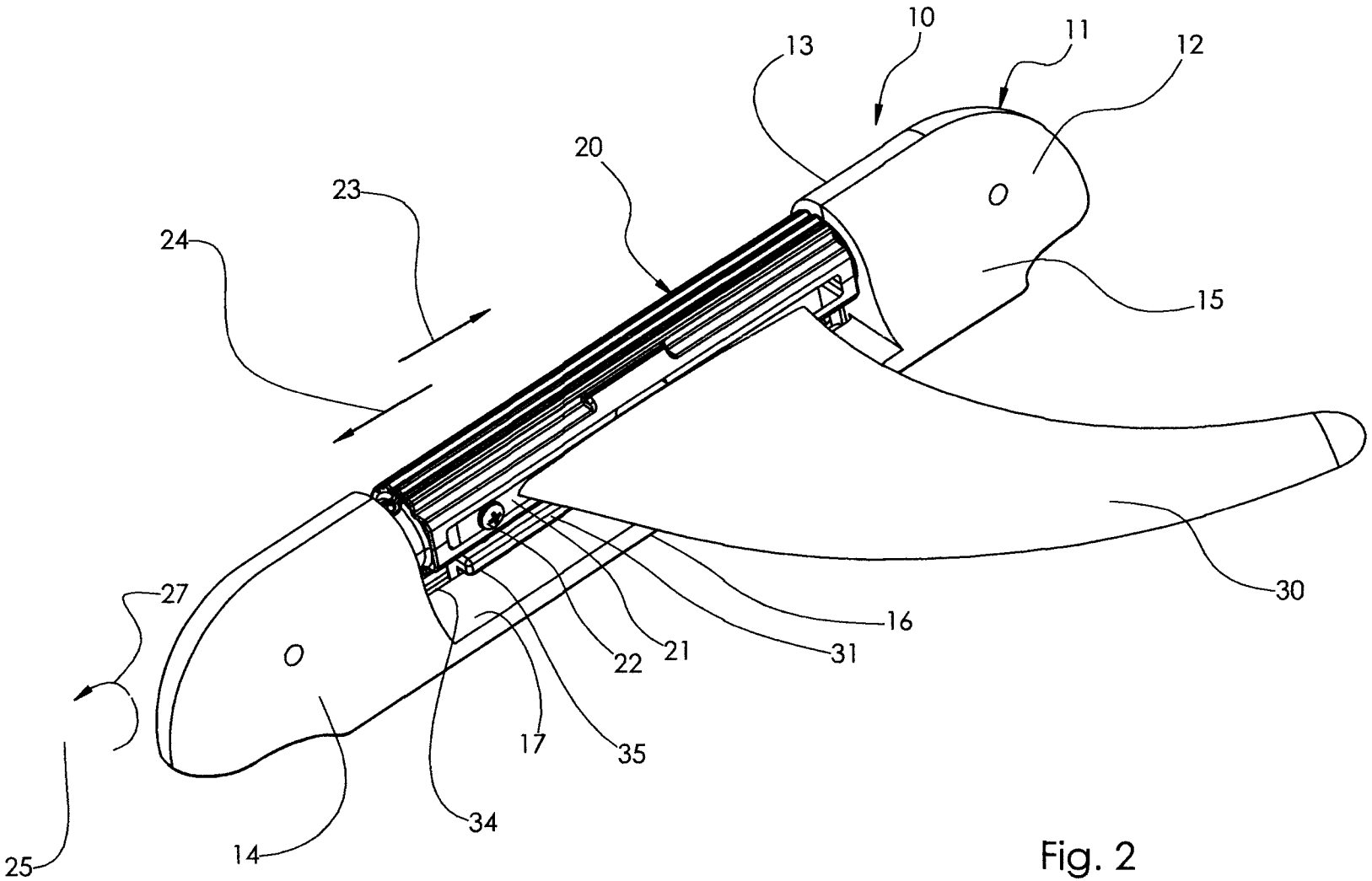
FIG. 2 sets forth a perspective view of a multiple position fin support constructed in accordance with the present invention supporting an illustrative fin in a left-side lowered position.
Figure 3:
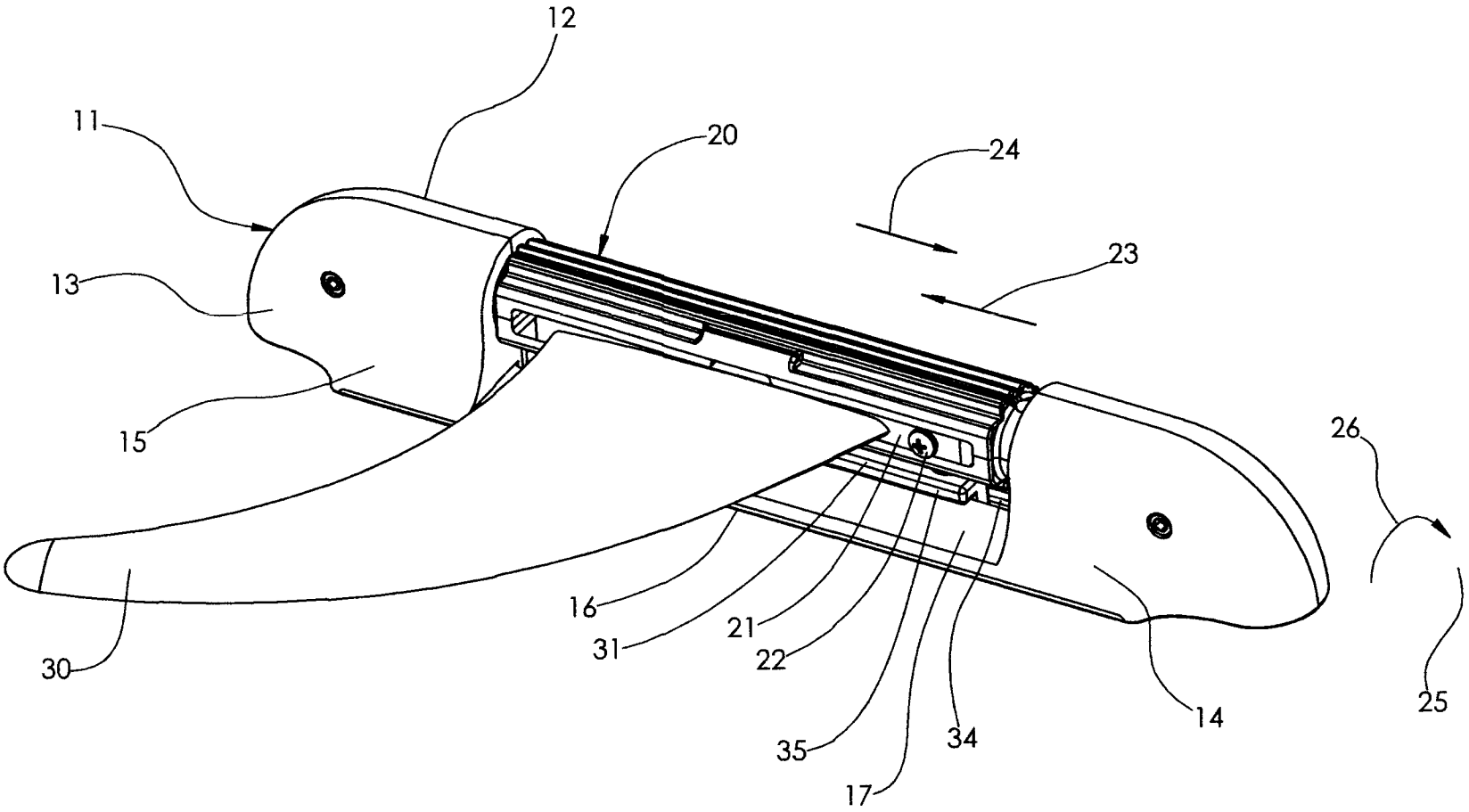
FIG. 3 sets forth a perspective view of a multiple position fin support constructed in accordance with the present invention supporting an illustrative fin a right-side lowered position.

By means set forth below in greater detail, fin box 20 is supported between abutments 14 and 15 within gap 17 of fin base 11 in a rotational support which is, in essence, "detented" to latch the rotational position of fin box 20, and thereby fin 30, in a selected one of several available rotational positions. Thus, in accordance with an important aspect of the present invention, fin box 20 may be rotated between detented rotational positions and will be selectively positioned, and latched, at either an angular position extending fin 30 vertically as shown in FIG. 1 or, alternatively, at an angular position extending fin 30 to the left as shown in FIG. 2 or, by still further alternative, at an angular position extending fin 30 to the right as shown in FIG. 3. In this manner, and in further accordance with an important aspect of the present invention, fin base 11 facilitates the selective and latched positioning of fin 30 vertically for typical use or, alternatively, pivoted to the left or right lying along the undersurface of the cooperating board during periods of nonuse, transport or storage.

More specifically, FIG. 1 shows fin base 11 having fin 30 extending vertically and having fin box 20 latched in the corresponding position of rotation. By means set forth below in greater detail, this vertical extension of fin 30 is maintained by an internal spring housed within forward abutment 14 which urges fin box 20 rearward in the direction indicated by arrow 23 thereby maintaining fin box 20 in a latched position. In accordance with an important aspect of the present invention, fin 30 may be repositioned in either the left side position shown in FIG. 2 or the right side position shown in FIG. 3 for purposes of protecting fin 30 against damage. This protective positioning of fin 30 is accomplished by initially forcing the combined assembly of fin box 20 and fin 30 forwardly, in the direction indicated by arrow 24, overcoming the restraining spring force within abutment 14 and releasing the position latch operative upon fin box 20 (seen below in FIG. 6). Once fin box 20 and fin 30 have been moved forwardly within gap 17, they may be pivoted to the right, as indicated by arrow 27, to place fin 30 in the right side position shown in FIG. 3 or, alternatively, pivoted to the left in the manner shown by arrow 26, to configure fin 30 in the left side position shown in FIG. 2. Once this repositioning of fin 30 has taken place, fin 30 is released and the internal spring within abutment 14 moves fin box 30 into a latched side, or folded, position overlying the undersurface of the cooperating paddleboard or surfboard. When thus positioned, fin 30 is significantly protected from damage during nonuse, transport and storage.

In further accordance with the present invention, fin 30 may be restored to the vertically extending position shown in FIG. 1 by once again forcing fin box 20 forwardly against the internal spring within abutment 14 in the direction indicated by arrow 24 which, in turn, releases the position latch operative upon fin box 20. This allows the rotation of fin 30 to the vertical position shown in FIG. 1. With fin 30 again restored to its vertical position, fin box 20 is released and the internal spring within abutment 14 urges fin box 20 rearward against rearward abutment 15 once again engaging the position latch and detenting fin 30 in its vertical position.

It will be apparent to those skilled in the art that the present invention multiple position fin support provides a substantial improvement over conventional prior art fin attachment apparatus. It will be equally apparent to those skilled in the art that the ease with which fin 30 may be positioned in either a vertical position suitable for use, or a folded position on either side of the fin base suitable for periods of nonuse, transport and storage, avoids the need for the user to have access to tools or any other apparatus before, during or after water support activities. In its preferred fabrication, the present invention fin support is fabricated virtually entirely of high-strength high-quality molded plastic components formulated to resist corrosion when exposed to saltwater. As a result, little if any maintenance is required to maintain the present invention multiple position fin support between uses.

FIG. 2 sets forth a perspective view of fin support 10 having fin 30 positioned in a left side configuration. As described above, and in accordance with an important aspect of the present invention, fin box 20 is rotatable within fin support 10 to facilitate positioning fin 30 in the left side position shown in FIG. 2 in order to protect fin 30 during periods of nonuse, transport and storage. More specifically, fin support 30 includes a fin base 11 formed of mirror image base halves 12 and 13 which are joined by conventional fasteners (not shown). Fin base 11 includes a forward abutment 14 and a rearward abutment 15 separated by a gap 17. Fin base 11 further defines a bottom surface 16 which is generally planar and configured to be received upon the undersurface of a cooperating board (seen in FIG. 5).

Fin support 10 further includes a fin box 20 which is supported between abutments 14 and 15 within gap 17 in a manner that facilitates rotation about an axis of rotation 25 in the manner indicated by arrow 27. Fin box 20 supports fin 30 in an attachment described below in greater detail. Fin box 20 is further movable within gap 17 in the directions indicated by arrows 23 and 24 and is urged rearwardly by an internal spring (shown in FIG. 6) within abutment 14. Fin base 11 further defines a slot 34 within which a tie-down 31 is captivated. Tie-down 31 includes a flange 35 which maintains the position of tie-down 31 within gap 17. Fin 30 is received within a fin slot 21 formed in fin box 20 and is secured therein by a fastener 22.

As mentioned above, the left side positioning of fin 30 shown in FIG. 2 is intended to position fin 30 along the undersurface of the host board and thereby protect it from damage during periods of nonuse, transport and storage. In accordance with the present invention, this left side position is secured by the spring and latch apparatus operative upon fin box 20 which is shown and described in detail in FIGS. 7A through 7D. Suffice it to note here that the left side position latch is maintained by the urging of the internal spring within forward abutment 14. Fin 30 may be repositioned to the vertical position shown in FIG. 1 to accommodate use by forcing fin box 20 forwardly in the direction indicated by arrow 24 overcoming the force of the internal spring within forward abutment 14 and releasing the position latch operative upon fin box 20. Thereafter, the user is able to rotate fin box 20 and fin 30 about axis of rotation 25 in the direction indicated by arrow 27 to return fin 30 to the vertical position shown in FIG. 1. In further accordance with the present invention, this vertical position is then latched when fin box 20 is released allowing the internal spring within forward abutment 14 to urge fin box 20 rearwardly in the direction indicated by arrow 23. Thus, it will be apparent to those skilled in the art that the present invention fin support facilitates the easy movement of fin 30 between the vertical position of use and the left side position which protects fin 30 during periods of nonuse, transport and storage.

FIG. 3 sets forth a perspective view of fin support 10 having fin 30 positioned in a right side configuration. As described above, and in accordance with an important aspect of the present invention, fin box 20 is rotatable within fin support 10 to facilitate positioning fin 30 in the right side position shown in FIG. 3 in order to protect fin 30 during periods of nonuse, transport and storage.

More specifically and as is described above, fin support 30 includes a fin base 11 formed of mirror image base halves 12 and 13 which are joined by conventional fasteners (not shown). Fin base 11 includes a forward abutment 14 and a rearward abutment 15 separated by a gap 17. Fin base 11 further defines a bottom surface 16 which is generally planar and configured to be received upon the undersurface of a cooperating board (seen in FIG. 5).

Fin support 10 further includes a fin box 20 which is supported between abutments 14 and 15 within gap 17 in a manner that facilitates rotation about an axis of rotation 25 in the manner indicated by arrow 27. Fin box 20 supports fin 30 in an attachment described below in greater detail. Fin box 20 is further movable within gap 17 in the directions indicated by arrows 23 and 24 and is urged rearwardly by an internal spring (shown in FIG. 6) within abutment 14.

As is also mentioned above, the right side positioning of fin 30 shown in FIG. 3 is intended to position fin 30 along the undersurface of the host board and thereby protect it from damage during periods of nonuse, transport and storage. In accordance with the present invention, this right side position is secured by the spring and latch apparatus operative upon fin box 20 which is shown and described in detail in FIGS. 7A through 7D. Suffice it to note here that the right side position latch is maintained by the urging of the internal spring within forward abutment 14. Fin 30 may be repositioned to the vertical position shown in FIG. 1 to accommodate use by forcing fin box 20 forwardly in the direction indicated by arrow 24 overcoming the force of the internal spring within forward abutment 14 and releasing the position latch operative upon fin box 20. Thereafter, the user is able to rotate fin box 20 and fin 30 about axis of rotation 25 in the direction indicated by arrow 26 to return fin 30 to the vertical position shown in FIG. 1. In further accordance with the present invention, this vertical position is then latched when fin box 20 is released allowing the internal spring within forward abutment 14 to urge fin box 20 rearwardly in the direction indicated by arrow 23. Thus, it will be apparent to those skilled in the art that the present invention fin support facilitates the easy movement of fin 30 between the vertical position of use and the right side position which protects fin 30 during periods of nonuse, transport and storage.

Figure 4:
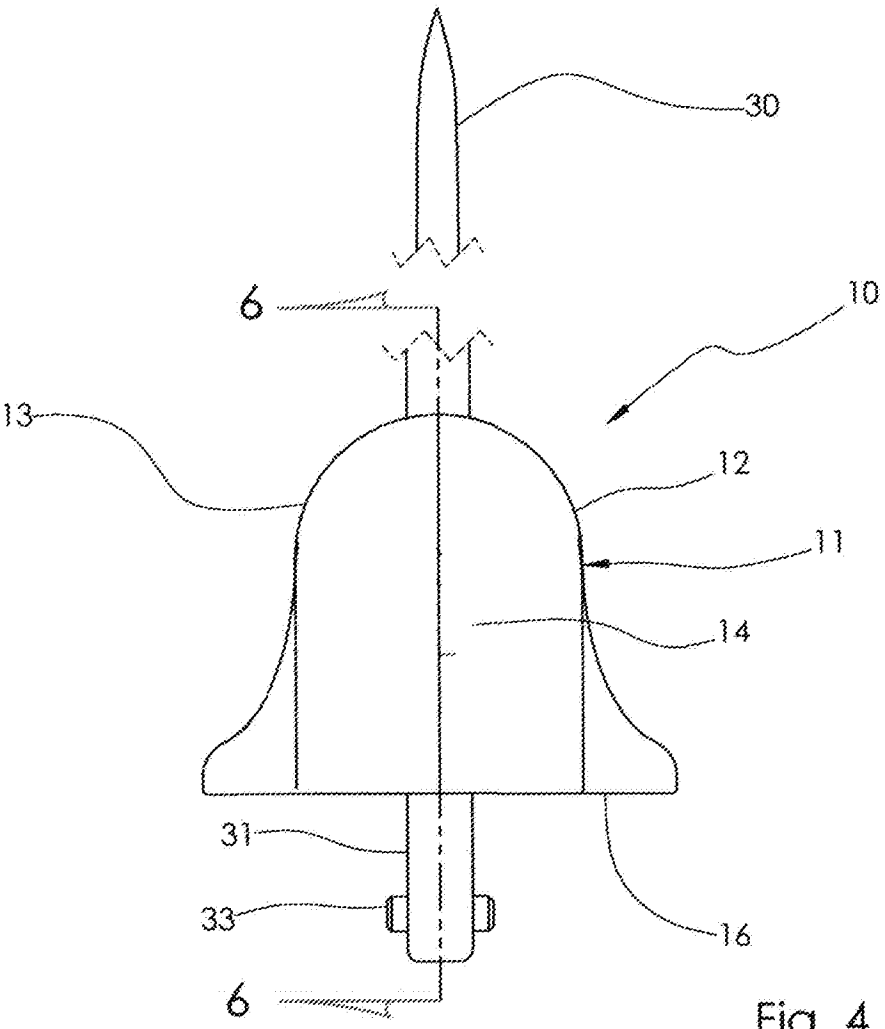
FIG. 4 sets forth a front view of a multiple position fin support constructed in accordance with the present invention supporting an illustrative fin in a vertical position.
Figure 6:
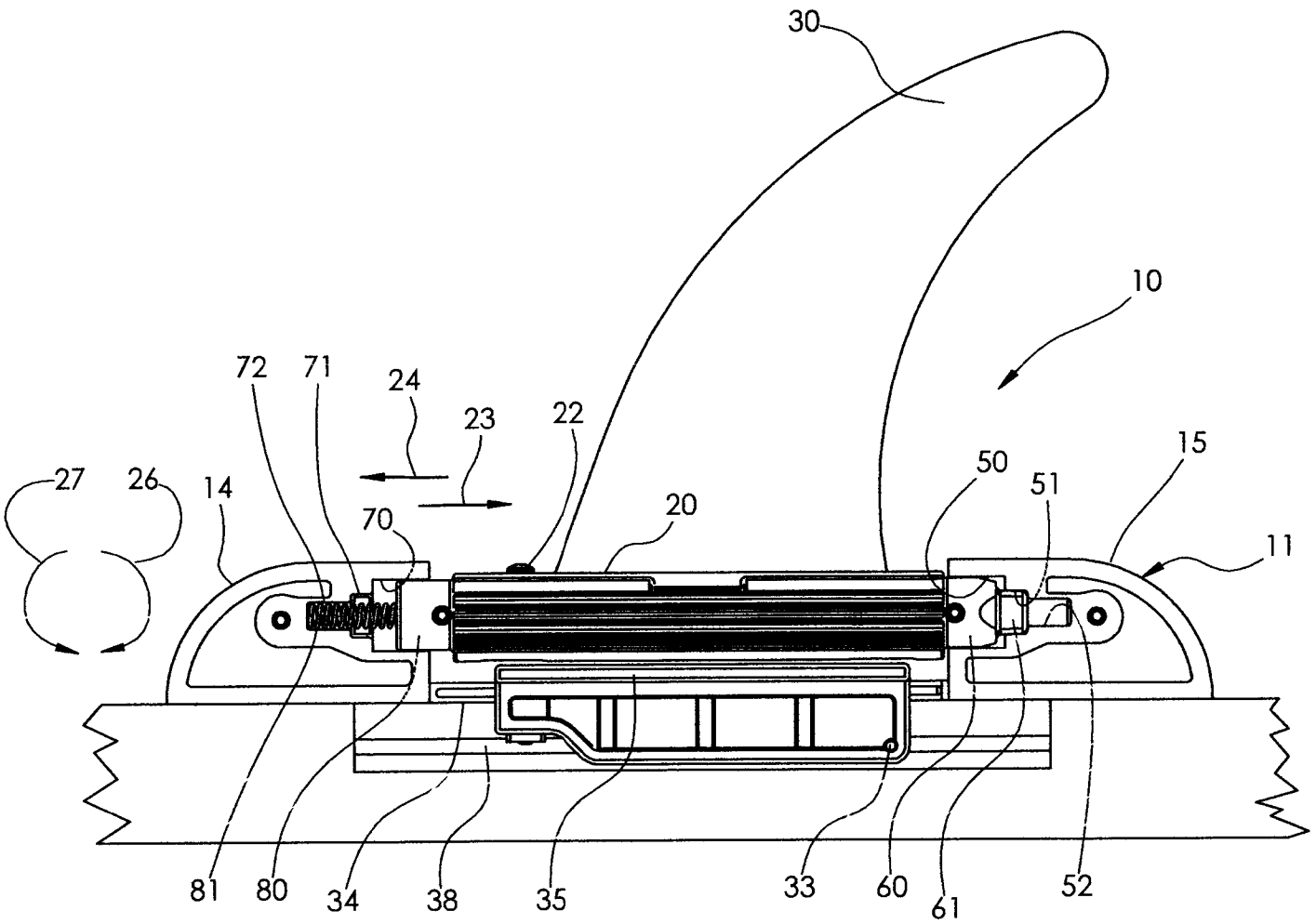
FIG. 6 sets forth a section view of a multiple position fin support constructed in accordance with the present invention taken along section lines 6-6 in FIG. 4.

FIG. 4 sets forth a front view of the present invention fin support having fin 30 in a vertical position. As described above, fin support 10 is constructed in accordance with the present invention and includes a fin base 11 formed of a pair of mirror image base halves 12 and 13. As is also described above, fin support 10 supports a fin 30 which is shown in FIG. 4 in a vertical position. Fin base 11 further defines a bottom surface 16 through which a tie-down 31 extends downwardly. Tie-down 31 includes a generally cylindrical pin 33 extending through tie-down 31 and outwardly from each side thereof. It will be apparent to those skilled in the art from reference to FIG. 6 that when fin support 10 is placed upon the undersurface of a cooperating board which includes a conventional fin box such as shown in FIG. 6, that tie-down 31 extends downwardly into that fin box and is received therein to secure fin support 10 upon the undersurface of the cooperating board. While the manner in which tie-down 31 is secured within the fin box of a cooperating board is set forth below in FIG. 6 in greater detail, it is sufficient to note in FIG. 4 the manner in which tie-down 31 extends downwardly beyond bottom surface 16 of fin base 11 to effectuate this attachment.

Figure 5:
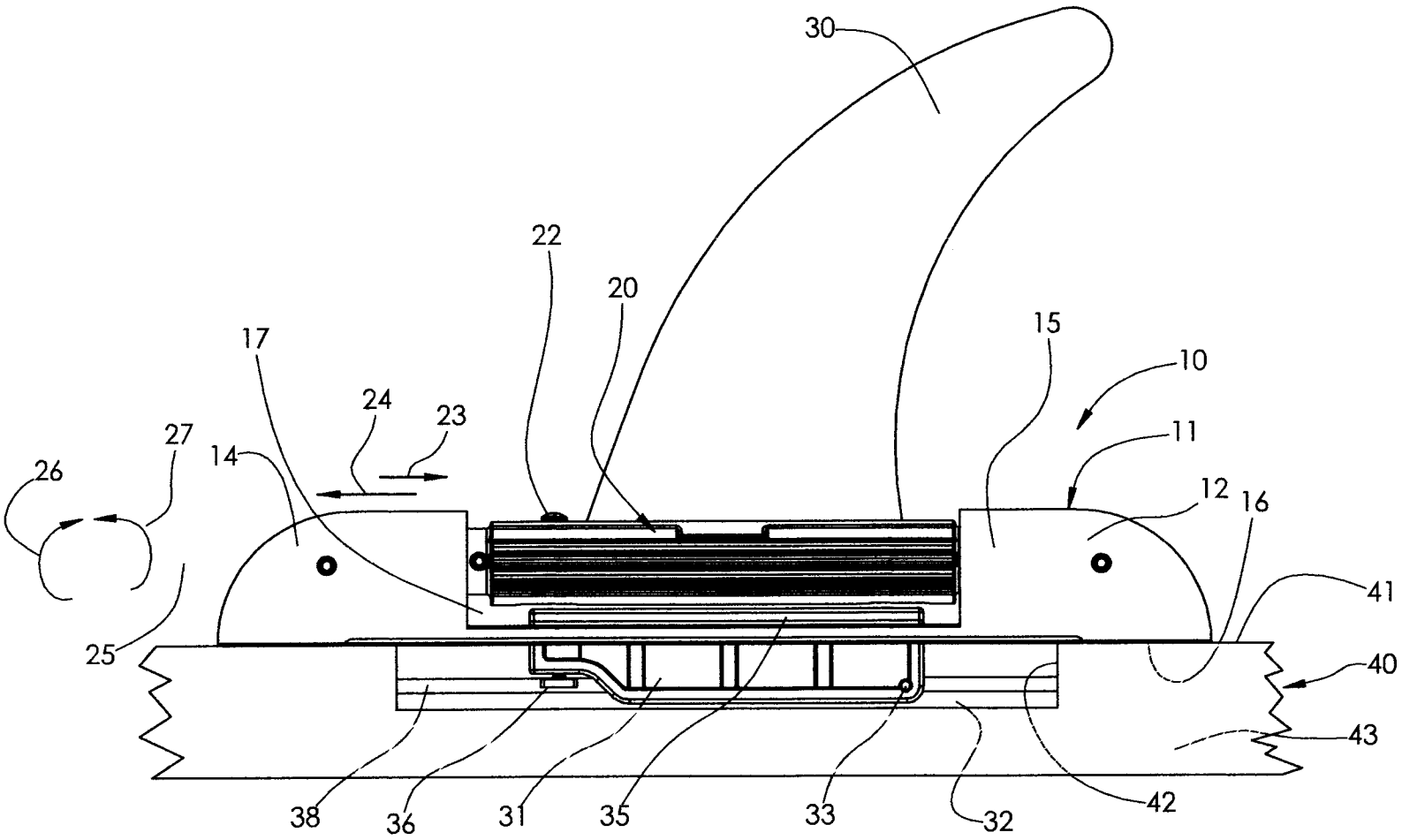
FIG. 5 sets forth a side elevation view of a multiple position fin support constructed in accordance with the present invention together with a partial section view of a cooperating paddleboard and fin box.

FIG. 5 sets forth a side elevation view of fin support 10 positioned upon the undersurface of an illustrative board 40. Board 40 will be understood to be of conventional construction and illustrative of boards such as paddle boards or surfboards or other water sport boards which utilize one, or more, extending fins. For purposes of explaining the attachment of fin support 10 to board 40, the latter is shown in partial section. It will be understood that board 40 is representative of conventional boards which utilize a fin box to receive and secure a fin in a removable attachment. Accordingly, board 40 includes a foam core 43 within which a receptacle 42 is formed. A board fin box 32 is received within receptacle 42 and secured therein by conventional attachment such as adhesive attachment, or the like. Board 40 further includes an undersurface 41 which will be understood to support a sealing layer such as an epoxy resin and fiberglass layer which functions to seal foam core 43. In further accordance with the conventional fabrication of board 40, it will also be understood that this epoxy and fiberglass layer encloses the outer surface of foam core 43 and further serves to enclose and secure board fin box 32. Thus, it will be apparent that the foregoing described structure of board 40 is representative of an entirely conventional board construction. It will be further recognized that, in accordance with an important aspect of the present invention, fin support 10 cooperates with and is attachable to an otherwise conventional paddleboard or surfboard or the like without modification of the board. That is to say, tie-down 31 is received within and cooperates with board fin box 32 in the same manner as a conventional fin. This renders the attachment of fin support 10 to an otherwise conventional board to be as easy as attaching a conventional fin. It will be apparent that the present invention fin support may be used on boards having a different fin box and fin attachment by altering tie-down 31 accordingly without departing from the spirit and scope of the present invention.

More specifically, a conventional board 40 includes a foam core 43 defining a board undersurface 41 and a fin box receptacle 42. A board fin box 32 is received and secured within receptacle 42 by conventional attachment such as adhesive or the like. Board fin box 32 defines a channel 38 extending substantially the length of fin box 32. As described above, it will be understood that foam core 43 is encased within a sealing layer of material such as fiberglass and epoxy resin which forms a thin outer seal for foam core 43. As is also described above, this outer sealing layer further serves to assist in the securing of board fin box 32 within receptacle 42 of foam core 43.

As described above, fin support 10 includes a fin base 11 formed of a pair of mirror image base halves 12 and 13 (base half 13 seen in FIG. 2). As is also described above, fin base 11 defines a forward abutment 14 and a rearward abutment 15 separated by a gap 17. Fin base 11 further defines a bottom surface 16 which rests upon board undersurface 41. A fin box 20 supporting a fin 30 is supported within gap 17 of fin base 11 in an attachment which facilitates both rotation of fin box 20 about an axis of rotation 25 in the directions indicated by arrows 26 and 27 and lateral movement in the directions indicated by arrows 23 and 24. Fin box 20 supports a fin 30 which is received within a fins slot 21 (seen in FIG. 1). Fin support 10 further includes a tie-down 31 which extends downwardly through slot 34 (seen in FIG. 1) and is received within board fin box 32. Tie-down 31 supports a fastener 36 which extends into channel 38 and which cooperates with a fastener 37 (seen in FIG. 1). Tie-down 31 further includes a pin 33 which extends outwardly from both sides of tie-down 31 into channel 38. Tie-down 31 further includes a flange 35. Pin 33 together with fasteners 36 and 37 cooperate to engage channel 38 of board fin box 32 and secure tie-down 31, and thereby fin support 10, against board undersurface 41.

FIG. 6 sets forth a section view of fin support 10 taken along section lines 6-6 in FIG. 4. With temporary return to FIG. 1, it should be noted that, because fin base 11 is preferably fabricated of a pair mirror image base halves 12 and 13 joined by fasteners, FIG. 6 may also be regarded as a side elevation view of base half 13 having base half 12 removed therefrom to show the interior components of fin base 11 and fin box 20. For purposes of consistency, FIG. 6 will be treated as a section view and referred to accordingly in this description.

Returning to FIG. 6, fin support 10 is shown positioned upon the undersurface of an illustrative board 40 in the same manner as shown in FIG. 5. FIG. 6 differs from FIG. 5 in that the section view thereof shows the internal structure of fin base 11 and cooperating components supporting fin box 20. As mentioned above, board 40 is shown in partial section and will be understood to be of conventional construction and illustrative of boards such as paddle boards or surfboards or other water sport boards which utilize one, or more, extending fins. Board 40 is representative of conventional boards which utilize a fin box to receive and secure a fin in a removable attachment. Accordingly, board 40 includes a foam core 43 within which a receptacle 42 is formed. A board fin box 32 is received within receptacle 42 and secured therein by conventional attachment such as adhesive attachment, or the like. Board 40 further includes an undersurface 41. It will be further recognized that, in accordance with an important aspect of the present invention, fin support 10 cooperates with and is attachable to an otherwise conventional paddleboard, or surfboard, or the like, without modification of the board fin box or board. That is to say, tie-down 31 is received within and cooperates with board fin box 32 in the same manner and attachment as would a conventional fin.

More specifically, a conventional board 40 includes a foam core 43 defining a board undersurface 41 and a fin box receptacle 42. A board fin box 32 is received and secured within receptacle 42 by conventional attachment such as adhesive or the like. Board fin box 32 defines a channel 38 extending substantially the length of board fin box 32. As described above, it will be understood that foam core 43 is encased within a sealing layer of material such as fiberglass and epoxy resin which forms a thin outer seal for foam core 43. As is also described above, this outer sealing layer further serves to assist in the securing of board fin box 32 within receptacle 42 of foam core 43.

As described above, fin support 10 includes a fin base 11 formed of a pair of mirror image base halves 12 and 13 (base half 12 seen in FIG. 2). As is also described above, fin base 11 defines a forward abutment 14 and a rearward abutment 15 separated by a gap 17. Fin base 11 further defines a bottom surface 16 which rests upon board undersurface 41. A fin box 20 supporting a fin 30 is supported within gap 17 of fin base 11 in an attachment which facilitates both rotation of fin box 20 about an axis of rotation 25 in the directions indicated by arrows 26 and 27 and lateral movement in the directions indicated by arrows 23 and 24. Fin box 20 supports a fin 30 which is received within a fin slot 21 (seen in FIG. 1). Fin support 10 further includes a tie-down 31 which extends downwardly through slot 34 and is received within board fin box 32. Tie-down 31 supports a fastener 36 which extends into and is captivated within channel 38 of board fin box 32. A fastener 37 (seen in FIG. 1) engages fastener 36 and secures tie-down 31 within slot 34 of fin base 11. Tie-down 31 further includes a pin 33 which extends outwardly from both sides of tie-down 31 into channel 38 of board fin box 32. Tie-down 31 further includes a flange 35 extending beyond slot 34. Pin 33 together with fasteners 36 and 37 cooperate to engage channel 38 of board fin box 32 and secure tie-down 31, and thereby fin support 10, against board undersurface 41.

Forward abutment 14 and rearward abutment 15 of fin base 11 are mirror images of each other and are otherwise identical in their interior construction. Thus, abutment 14 defines a generally cylindrical bearing race 70 together with a square shaped latch receptacle 71 and a generally cylindrical spring bore 72, all in coaxial arrangement. Similarly, rearward abutment 15 of fin base 11 defines a generally cylindrical bearing race 50 together with a square cross-section latch receptacle 51 and a generally cylindrical spring bore 52, all in coaxial arrangement. The utilization of mirror image otherwise identical structures within forward abutment 14 and rearward abutment 15 facilitates the assembly of fin box 20 between abutments 14 and 15 in the arrangement shown in FIGS. 6 or, alternatively, in a reverse arrangement should the need arise. However, in most uses of the present invention fin support, it has been found preferable to assemble fin box 20 in the orientation shown in FIG. 6. Accordingly, the descriptions set forth herein will utilize the orientation of fin box 20 within fin base 11 shown in FIG. 6.

Figure 8:
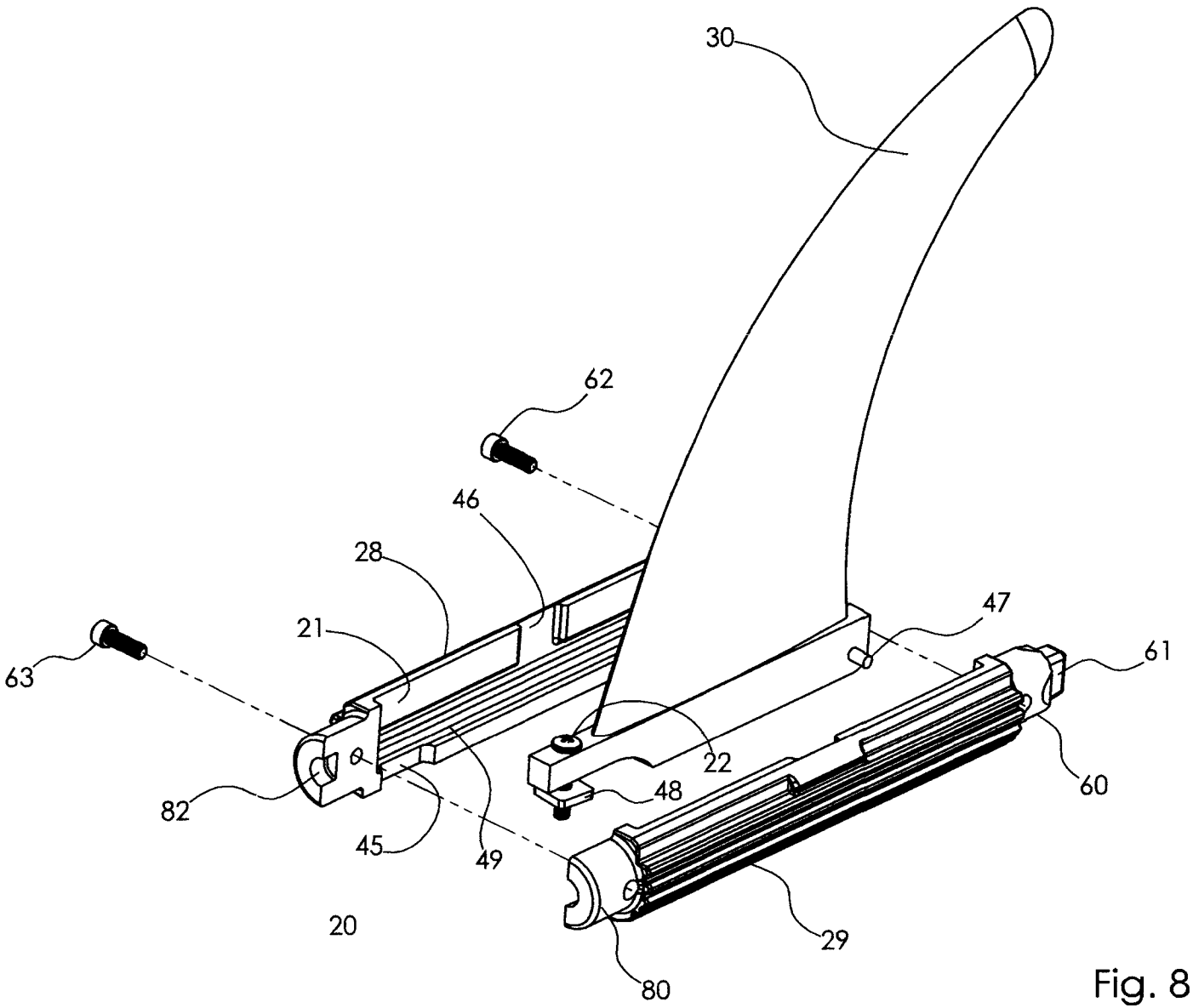
FIG. 8 sets forth a perspective assembly view of the fin box assembled to an illustrative fin utilized in the present invention multiple position fin support.

Fin box 20 receives and supports fin 30 in an attachment which is described in greater detail in FIG. 8. However, suffice it to note here that fin box 20 defines a fin slot 21 (seen in FIG. 1) which receives the lower end of fin 30 such that fin 30 is secured within fin slot 21 by a fastener 22.

Fin box 20 includes an end bearing 80 which is generally cylindrical in shape and which is received within bearing race 70 of forward abutment 14 in a fit which facilitates rotation of end bearing 80 within bearing race 70. As is better seen in FIG. 9, end bearing 80 further defines a spring cup 82 which receives one end of a spring 81. Spring 81 extends from spring cup 82 of end bearing 80 through the remainder of bearing race 70 and latch receptacle 71 into spring bore 72. Spring 81 is compressed within spring bore 81 and spring cup 82 such that it exerts an expanding force against end bearing 80 in the direction indicated by arrow 23.

The remaining end of fin box 20 defines a generally cylindrical end bearing 60 and a square cross-section latch post 61. End bearing 60 is rotatable within bearing race 50 and provides support for fin box 20 within rearward abutment 15. Latch post 61 is received within square cross-section latch receptacle 51. The extension of latch post 61 into latch receptacle 51 prevents rotation of fin box 20 and thereby maintains the latched position of fin 30 in the vertical position shown in FIG. 6. This latched position is further maintained by the force of spring 81 against end bearing 80 in the direction indicated by arrow 23 which keeps latch post 61 within latch receptacle 51.

As described above, and in accordance with an important aspect of the present invention, fin box 20 and fin 30 may be rotated to alternative left side (seen in FIG. 2) and right side (seen in FIG. 3) positions. The operation of the latch mechanism utilized in fin support 10 is set forth below in FIGS. 7A through D the in greater detail. However, suffice it to note here with reference to FIG. 6 that fin box 20 and fin 30 are maintained in the vertical fin position shown in FIG. 6 by the engagement of square shaped latch post 61 within square shaped latch receptacle 51. In addition, this engagement is maintained by the force of spring 81 in the direction indicated by arrow 23. Accordingly, the position of fin 30 may be changed by moving fin box 20 and fin 30 against the force of spring 81 in the direction indicated by arrow 24 which withdraws latch post 61 from latch receptacle 51 and allows the rotation of fin box 20 and fin 30 to either a left side or right side position. The use of a square cross section shape for latch receptacle 51 and square cross section latch post 61 defines three useable detent positions for the rotation of fin box 20 (a fourth position against board surface 16 is not useable). This, in turn, allows fin box 20 to be rotated and latched in either a left side, or right side, or vertical position when fin box 20 is released and spring 81 returns latch post 61 into latch receptacle 51.

FIGS. 7A through 7D set forth sequential partial section views of rearward abutment 14 and a portion of fin box 20 illustrating the operation by which the rotational position of fin box 20 is latched or detented at a selected position. Accordingly, with reference to FIGS. 7A through 7D concurrently, rearward abutment 15 of fin base 11 is shown in section view and defines a generally cylindrical bearing race 50 together with a square cross-section latch receptacle 51 and a generally cylindrical spring bore 52 all in coaxial arrangement. Correspondingly, fin base 20 supports fin 30 in the above described attachment and includes an end bearing 60 together with a square cross-section latch post 61. It will be recalled from the above descriptions that spring 81 (seen in FIG. 6) exerts an expanding spring force against end bearing 80 (also seen in FIG. 6) which urges fin box 20 in the direction indicated by arrow 23. It will be further recalled that this spring force is operative to maintain the position of latch post 61 within latch receptacle 51. It will also be recalled that end bearing 60 is received within bearing race 50 to provide a rotatable support which allows the rotation of fin box 20.

Figures 7A, 7B, 7C, 7D:
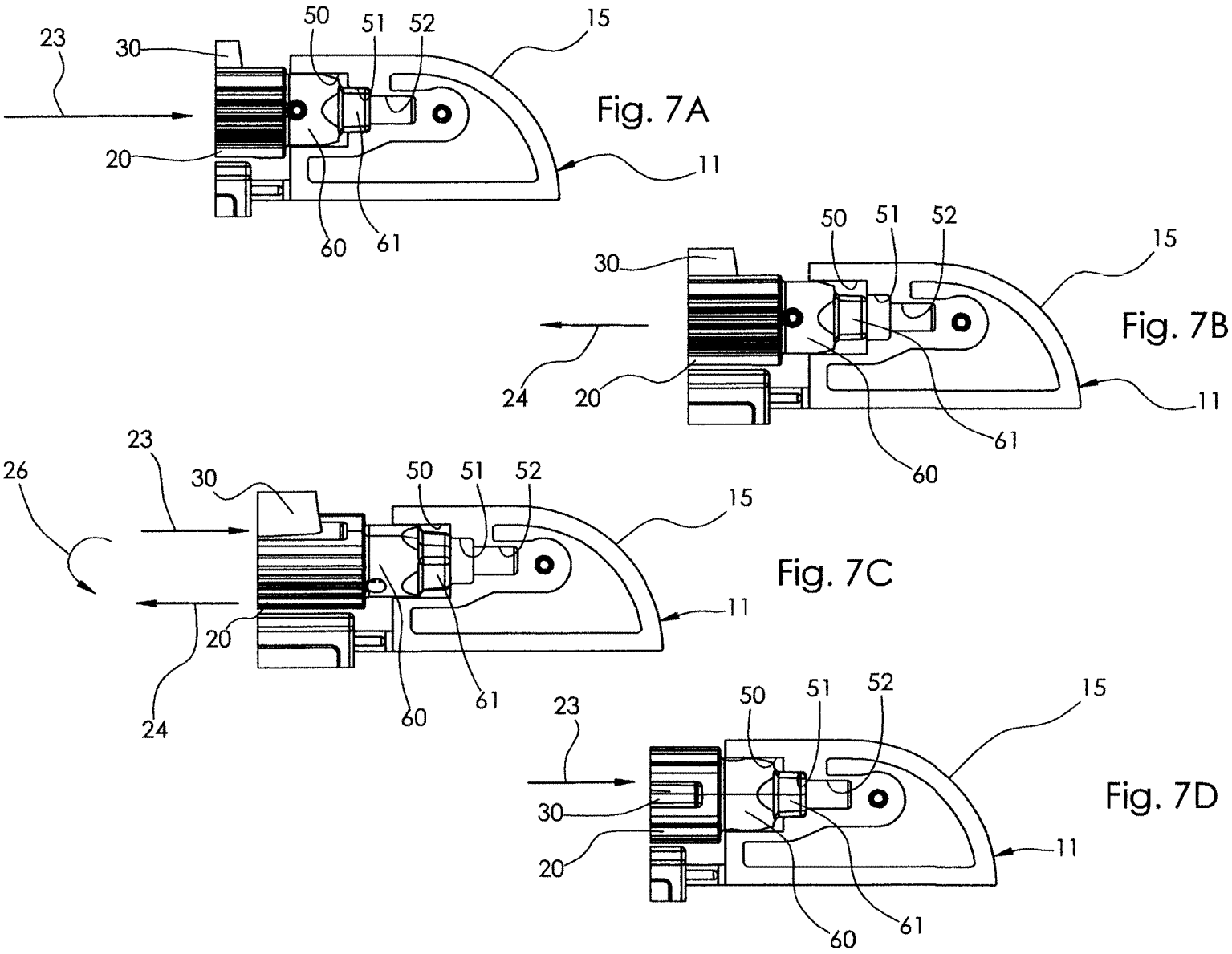
FIGS. 7A, 7B, 7C and 7D set for sequential partial section views of the rear portion of the present invention fin support and cooperating fin box during an illustrative change of fin position.

With particular reference to FIG. 7A, the end portion of fin box 20 within rearward abutment 15 are shown in the relative positions corresponding to the vertical fin positioning shown in FIG. 6. Thus, it will be understood that in the position shown in FIG. 7A, fin 30 extends vertically in the manner seen in FIG. 6. In this position, the force of spring 81 (seen in FIG. 6) urges fin box 20 to the position shown in which square shaped latch post 61 is received within latch receptacle 51. As a result, the rotational position of fin box 20 is latched or detented in the vertical fin position. This position is maintained so long as spring 81 (seen in FIG. 6) is able to maintain the position of latch post 61 within latch receptacle 51.

FIG. 7B shows the position of the position latch elements of fin box 20 and rearward abutment 15 once the user has moved fin box 20 in the direction indicated by arrow 24 overcoming the force of spring 81 (seen in FIG. 6). This corresponds to a latch release position characterized by the withdrawal of latch post 61 from latch receptacle 51. It will be noted that this movement of fin box 20 does not withdraw the entirety of end bearing 60 from bearing race 50. Accordingly, in the position shown in FIG. 7B, fin box 20 remains rotationally supported by the cooperation of end bearing 60 within bearing race 50. Of importance to note in FIG. 7B is the withdrawal of latch post 61 from latch receptacle 51 which fully disengages any restriction upon rotation of fin box 20. Accordingly, once the position shown in FIG. 7B has been attained, fin box 20 and fin 30 may be rotated to either a left side or right side fin protective position.

FIG. 7C shows an intermediate stage of position change as fin box 20 continues to be urged in the direction indicated by arrow 24 overcoming the force of spring 81 (seen in FIG. 6) and continuing to withdraw latch post 61 from latch receptacle 51 with the added movement of rotating fin box 20 in the direction indicated by arrow 26. At this intermediate position, latch post 61 is rotated out of alignment with latch receptacle 51 and thus is not able to move into latch receptacle 51. The rotation of fin box 20 in the direction indicated by arrow 26 continues until fin box 20 assumes the position shown in FIG. 7D which corresponds to the left side fin position set forth above in FIG. 2.

FIG. 7D shows fin box 20 and fin 30 rotated to the left side position shown in FIG. 2. FIG. 7D also shows the component positions once the force against spring 81 (seen in FIG. 6) has been released and fin box 20 has moved in the direction indicated by arrow 23 under the urging of spring 81. It is of importance to note that the alignment of latch post 61 with latch receptacle 51 allows latch post 61 to be reinserted into latch receptacle 51 which in turn once again detents the rotational position of fin box 20. With latch post 61 engaged within latch receptacle 51 and with spring 81 (seen in FIG. 6) once again maintaining the spring force which establishes the position shown in FIG. 7D, the position latch is operative and further rotation of fin box 20 is prevented.

Accordingly, it will be apparent to those skilled in the art that the sequence of FIGS. 7A through 7D are equally illustrative of alternative rotations of fin box 20 and fin 30. For example, fin 30 may be restored to its vertical position by the above sequence. Initially, fin box 20 and fin 30 are forced in the direction indicated by the arrow 24 overcoming the force of spring 81 (seen in FIG. 6). Next, fin box 20 is rotated ninety degrees to the vertical position shown in FIG. 6. Finally, fin box 20 is released allowing spring 81 (seen in FIG. 6) to move latch post 61 into latch receptacle 51. Alternatively, the rotation of fin box 20 and fin 30 may be continued prior to release of fin box 20 until fin box 20 has assumed the right side fin position shown in FIG. 3. In this case, releasing fin box 20 establishes the latched position in the right side position in an analogous manner to that shown in FIGS. 7A through 7D.

As described above, the shape of latch receptacle 51 and latch post 61 (seen in FIG. 6) are both square shaped in cross-section and are essentially "matching". It will be apparent to those skilled in the art that the use of square cross-section shapes for latch receptacle 51 and latch post 61 is a preferred and is selected to define three usable detent positions operative upon fin box 20 each separated by a right angle. (The fourth detent position not being required or used due to the presence of the cooperating board). It will be apparent to those killed in the art, however, that the present invention is not limited to the use of a detenting and latch mechanism utilizing a square shape latch receptacle and a square cross-section latch post. Rather, a variety of cooperating shapes may be utilized without departing from the spirit and will of the present invention. Examples of alternative shapes include, but are not limited to, cooperating gear and tooth combinations, a triangular cross-section shape, or other shapes such as octagonal or the like. The defining characteristics of cooperating shapes being found in the detenting of the rotation of fin box 20 at selected rotational positions which, in turn, defines selected angular position for fin 30.

FIG. 8 sets forth a perspective assembly view of fin box 20 together with fin 30. In the preferred fabrication of the inventive fin support, fin box 20 is formed of a pair of mirror image fin box halves 28 and 29 which are joined by a pair of conventional fasteners 62 and 63 utilizing embedded fasteners (molded into fin box half 29). Thus, many of the features formed in fin box 20 are actually formed of portions in each of the fin box halves which are completed when the two fin box halves are joined. For example, fin box 20 defines a fin slot 21 which, as may be observed in FIG. 1, receives the lower end of fin 30. Fin slot 21 is actually formed of slot portions within fin box halves 28 and 29 which combine to form fin slot 21 when fin box half 28 and fin box half 29 are joined. In a similar fashion, fin box 20 defines an end bearing 80 within which a spring cup 82 is formed. A channel 49 is formed within fin box 20 and receives a fastener 48. Fin box 20 further defines an aperture 46 and an aperture 45 the functions of which are described below in greater detail. Fin box 20 further defines an end bearing 60 and a square cross-section latch post 61.

Fin 30 is constructed in accordance with conventional fabrication techniques and supports a threaded fastener 22 and a pin 47. While not visible in FIG. 8, it will be understood that pin 47 extends outwardly from both sides of the lower end of fin 30. The assembly of fin box 20 and fin 30 is carried forward by initially placing fastener 48 within the channel 49 formed within fin box 20. Thereafter, with fin 30 remaining separated from fin box 20, fin box halves 28 and 29 are brought together and secured with fasteners 62 and 63 while fastener 48 remains captive within channel 49. It will be noted that in the preferred assembly of fin box 20 to fin base 11, described below in FIG. 9, fin 30 remains separate from fin box 20 until after fin base 11 (seen in FIG. 9) is secured to the fin box of the cooperating board. This provides access to fastener 37 (seen in FIG. 9) through fin slot 21 and aperture 45 to secure tie-down 31 in the manner described below. With fin box halves 28 and 29 joined and with fin 30 not yet assembled, fin box 20 and its associated components may be assembled within fin base 11 in the manner described below in FIG. 9.

Figure 9:
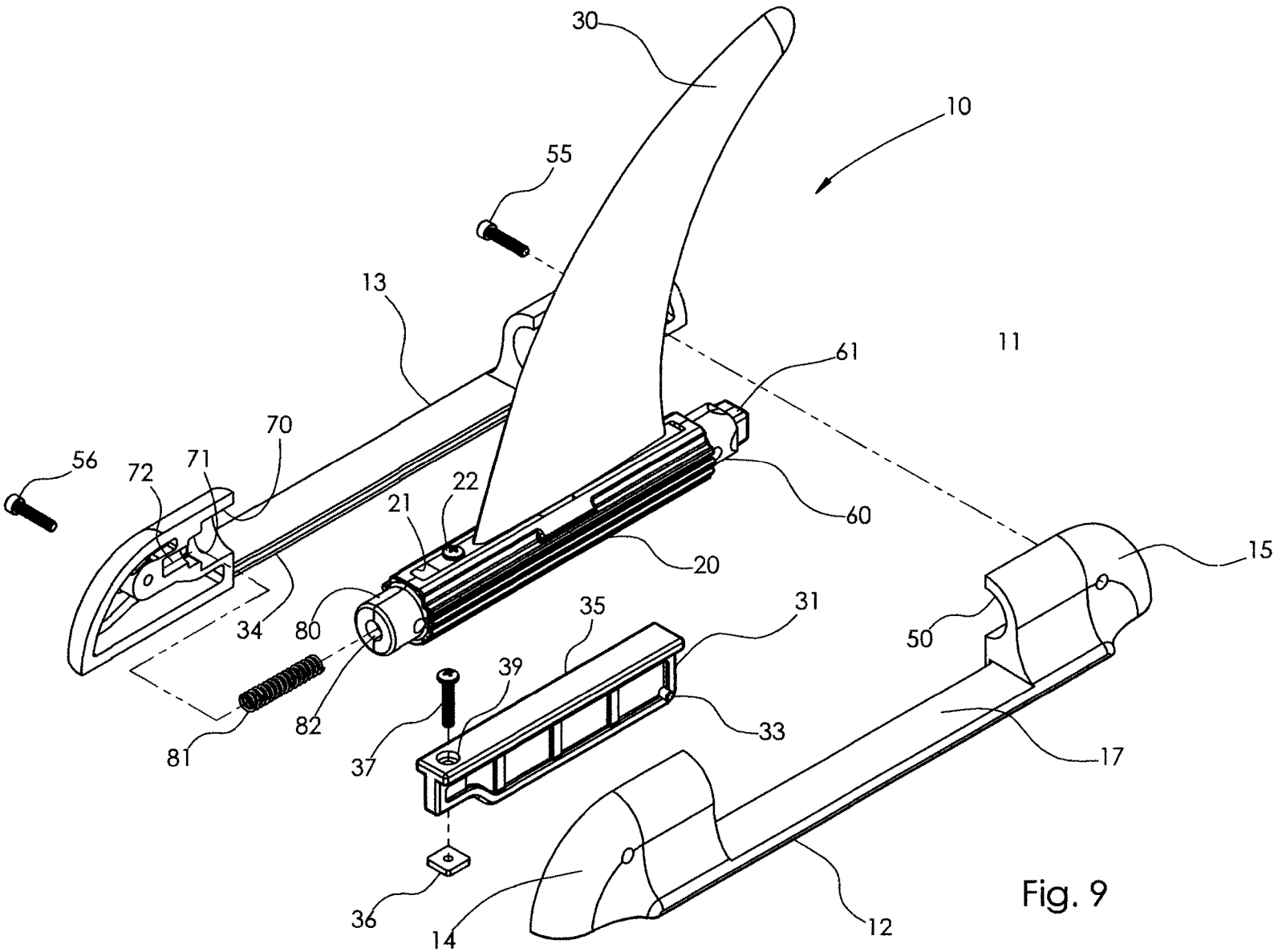
FIG. 9 sets forth a perspective assembly view of the present invention multiple position fin support receiving the fin box and illustrative fin shown in FIG. 8.

FIG. 9 sets forth a perspective assembly view of fin support 10. As described above, fin base 11 is formed of mirror image fin base halves 12 and 13 which are joined by fasteners 55 and 56. As is also described above, fin base 11 includes a forward abutment 14 and a rearward abutment 15 separated by a gap 17. Forward abutment 14 and rearward abutment 15 define substantially identical mirror images internally and are better seen above in FIG. 6. Thus, forward abutment 14 defines a generally cylindrical bearing race 70 and a square cross-section latch receptacle 71 together with a generally cylindrical spring bore 72. As is better seen in FIG. 6, rearward abutment 15 defines a generally cylindrical bearing race 50, a square cross-section latch receptacle 51 and a cylindrical spring bore 52. Fin support 10 further includes a tie-down 31 defining a flange 35 and supporting a pin 33. Pin 33 extends outwardly from both sides of tie-down 31. Tie-down 31 further defines an aperture 39 which receives a fastener 37 which, in turn, thread ably engages a fastener 36. A spring 81 is received within spring cup 82 and extends through bearing race 70 and latch receptacle 71 and is seated within spring bore 72.

Fin box 20 defines a slot 21 within which the lower end of a pin 30 is see. Fin 30 is secured in the manner described above by a fastener 22. Fin box 20 further defines an end bearing 80 and a spring cup 82 at one and there up. The remaining end of fin box 20 defines an end bearing 60 and a square cross-section latch post 61.

Fin support 10 is assembled by combining fin box 20 and spring 81 within fin base 13. In this assembly, spring 81 has one end received within spring bore 72 and the remaining end received within spring cup 82. It will be recalled from the descriptions of FIG. 8 above that in the preferred assembly of the present invention fin support, fin 30 is not, at this point, assembled to fin box 20 but is assembled as a final step. Accordingly, with fin 30 removed from fin box 20 and with fin box 20 and spring 81 positioned within fin base half 13 in the manner seen above in FIG. 6, tie-down 31 is positioned within slot 34. Thereafter, fin base half 12 is positioned upon fin base half 13 and secured thereto by fasteners 55 and 56. At this point, the assembly of fin base 11, tie-down 31 and fin box 20 may be secured within board fin box 32 in the manner shown in FIG. 5. Of particular importance is the positioning of fastener 36 within channel 38 of board fin box 32. With concurrent reference to FIGS. 8 and 9, it will be recalled that FIG. 8 shows aperture 45 defined within fin box 20. It will be further recalled that access to fastener 37 during the assembly of fin support 10 to the fin box of the cooperating board is provided by fin slot 21 and aperture 45. Thus, at this point of assembly tie-down 31 is received within board fin box 32 (seen in FIG. 5) and is secured by accessing fastener 37 through fin slot 21 and aperture 45 of fin box 20. Once fastener 37 engages fastener 36 and is tightened sufficiently to secure tie-down 31, the assembly of fin support 10 to the cooperating board is complete. At this point, fin 30 is assembled to fin box 20 by passing pin 47 through aperture 46 and thereafter aligning and tightening fastener 22 within fastener 48 to complete the attachment of fin 30. The assembly is now complete. It will be noted that fin 30 may be easily removed and replaced by simply loosening fastener 22 and removing fin 30 should fin 30 become damaged during use or otherwise require replacement.

What has been shown is an improved support for a fin extending downwardly from the undersurface of a water sport board which protects the fin from damage during periods of nonuse, transport and storage and which avoids the need for removal and reattachment of the fin between periods of use and periods of nonuse, transport and storage.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A multiple position fin support for supporting a fin upon the undersurface of a board, said multiple position fin support comprising:

a base having a forward abutment, a rearward abutment and a gap therebetween;

a tie-down extending downwardly from said fin base for engaging a board fin box;

a fin box, supported between said abutments in said gap, movable in rotation and movable between a latched position and an unlatched position;

a fin removably secured to said fin box;

a latch operative in said latched position for detenting rotational movement of said fix box at selected rotational positions; and a spring urging said fix box toward said latched position, said fin box being movable to a selected one of said selected rotational positions by overcoming said spring to move said fin box from said latched position and rotating said fin box to said selected one of said selected positions, said selected rotational positions including a first position perpendicular to the undersurface of the board and a second position parallel to the undersurface of the board.

2. The multiple position fin support set forth in claim 1 wherein said selected rotational positions include a first position perpendicular to the undersurface of the board, a second position extending to the left side of said fin base parallel to the undersurface of the board and a third position extending to the right side of said fin base parallel to the undersurface of the board.

3. A multiple position fin support for use in cooperation with a water sport board having a board undersurface within which a board fin box is embedded and defines a fin receiving slot and a fin attachment apparatus and a fin having a lower portion configured to be received within the fin receiving slot and cooperate with the fin attachment apparatus to secure a fin within the board fin box, said multiple position fin support comprising:

a base having a bottom surface and a tie-down extending beyond said bottom surface, said tie-down defining a lower portion constructed to provide a lower portion configured to be received within the fin receiving slot and cooperates with the fin attachment apparatus to secure said tie-down within a board fin box;

a rotatable fin box rotatably supported by said base and defining a fin receiving slot and a fin attachment apparatus receiving and securing the fin;

a detent coupled between said base and said fin box defining a first detent position in which said fin box supports the fin perpendicular to the board undersurface and a second detent position in which said fin box supports the fin generally parallel to the board undersurface; and a detent release operative upon said detent to release said rotatable fin box from said detent and permit rotational movement of said rotational fin box between said detent positions, said tie-down being inserted into said fin receiving slot of a board fin box and secured therein to attach said base to a board undersurface, and a fin being inserted into said fin receiving slot of said rotatable fin box and attached thereto whereby the fin is supported by said rotatable fin box in either said first or second detent positions selectively and movable therebetween.

4. The multiple position fin support set forth in claim 3 wherein said rotatable fin box defines a first end having a first end bearing and a second end defining a second end bearing and wherein said base includes a first bearing race and a second bearing race, said first and second end bearings being received within said first and second bearing races, respectively.

5. The multiple position fin support set forth in claim 4 wherein said first end defines a spring cup and said second end defines a latch post and wherein said first bearing race includes a spring bore and said second bearing race includes a latch receptacle, said base further including a spring extending from said spring cup through said first bearing race into said spring bore.

6. The multiple position fin support set forth in claim 5 wherein said latch receptacle defines a square shape and said latch post defines a square shaped cross section small enough to fit within said latch receptacle but large enough to prevent rotation therein and wherein said spring provides a spring force urging said rotatable fin box toward insertion of said latch post into said latch receptacle.

7. The multiple position fin support set forth in claim 3 wherein said detent includes a latch receptacle defining a first shape and a latch post, said latch post defining a second shape sized and shaped to be insertable into said latch receptacle and withdrawn therefrom while being incapable of rotation within said latch receptacle, said latch post and said latch receptacle each being formed on said base and said rotatable fin box.

8. The multiple position fin support set forth in claim 3 wherein said bottom surface of said base defines a slot and wherein said tie-down extends downwardly through said slot.

* * * * *